United States Patent [19]

Ritzerfeld

[11] 4,069,757

[45] Jan. 24, 1978

[54] PROGRAMMED OPERATION OF ROTARY DUPLICATOR MACHINE CAPABLE OF WHOLE-PAGE, PARAGRAPHWISE AND LINEWISE PRINTING UPON WHOLE-PAGE SHEETS AND SMALLER-FORMAT CARDS OR SLIPS

[76] Inventor: Gerhard Ritzerfeld, Schorlemer Allee 14, 1000 Berlin 33, Germany

[21] Appl. No.: 789,434

[22] Filed: Apr. 20, 1977

[30] Foreign Application Priority Data

Apr. 26, 1976 Germany ..... 2618659

[51] Int. Cl.[2] ..... B41L 11/08

[52] U.S. Cl. ..... 101/132.5; 101/91

[58] Field of Search ..... 101/132.5, 131, 131.5, 101/132, 91, 92, 142

[56] References Cited

U.S. PATENT DOCUMENTS

| | | | |
|---|---|---|---|
| 3,220,342 | 11/1965 | Ritzerfeld et al. | 101/91 |
| 3,242,854 | 3/1966 | Ritzerfeld et al. | 101/132.5 X |
| 3,245,367 | 4/1966 | Ritzerfeld et al. | 101/132.5 X |
| 3,871,294 | 3/1975 | Kagari et al. | 101/132.5 |

*Primary Examiner*—Edward M. Coven
*Attorney, Agent, or Firm*—Michael J. Striker

[57] ABSTRACT

The printing form on the printing drum of the machine bears an image in the form of a multi-line text. A counterpressure element can be moved to an operative position to effect transfer of the whole text onto whole-page sheets or transfer of individual lines or line groups to smaller-format cards or slips. The counterpressure element is moved by an activatable moving unit. A sheet feeding unit is activatable for feeding whole-page sheets to the printing location. A card feeding unit is activatable for feeding smaller-format cards to the printing location. A diverting unit is activatable for diverting printed whole-page sheets directly to the delivery station and smaller-format cards to a branch path in which they are turned over and then deposited at the delivery station in the printing sequence. A marking unit is activatable for providing routing markings on the various sheets and cards. A programmable control system is automatically operative for activating preselectable ones of the aforementioned activatable units preselectable numbers of times in preselectable sequences.

12 Claims, 12 Drawing Figures

197
195
196
198
193
192
194
199
200

PROGRAMMED OPERATION OF ROTARY DUPLICATOR MACHINE CAPABLE OF WHOLE-PAGE, PARAGRAPHWISE AND LINEWISE PRINTING UPON WHOLE-PAGE SHEETS AND SMALLER-FORMAT CARDS OR SLIPS

BACKGROUND OF THE INVENTION

The invention relates, for example, to rotary duplicator machines including a rotary printing drum on which is mounted a printing form bearing an image in the form of a multiple line text. A moving means is activatable for causing a counterpressure roller to swing towards the printing drum, to transfer the entire text on the printing form onto whole-page sheets transported between the drum and the counterpressure roller, and to transfer individual lines of line groups onto smaller-format cards or slips transported between the drum and the counterpressure roller. A sheet feeding means is activatable for feeding whole-page sheets to the drum; a card feeding means is activatable for feeding smaller-format cards to the drum. A diverting means is activatable for diverting printed whole-page sheets transported away from the drum directly to a downstream delivery station, and for diverting smaller-format printed cards into a branch path in which the cards are turned over so as to be deposited at the delivery station each one printed-side-down upon the back of the previously printed card. A marking means located intermediate the drum and the delivery station is activatable for providing routing marks on the printed sheets and cards to facilitate their subsequent routing.

In particular, the invention is concerned with the control of the activation of such activatable means in a printing machine of the general type in question.

Rotary duplicator machines provided with plural sheet feeding units for feeding in different respective types of sheets are already known. The control of the feeding units is effected in dependence upon a preestablished program contained in a program storage. However, the programmed series of operations, i.e., the preselection of the activatable means to be activated, the number of activations of each activatable means, and the sequences of activations, is controlled in relation to the number of rotations performed by the rotary printing drum. For example, one feeding means feeds one sheet of a first type per printing drum rotation until the preselected number of rotations (assumed to correspond to the preselected number of sheets) have been performed. Thereupon, the next feeding means feeds one sheet of a second type per printing drum rotation, until the preselected number of rotations (likewise assumed to correspond to the preselected number of sheets) have been performed, and so forth. This known feeding means control system has the disadvantage that malfunctions of the feeding means are not taken into account by the control system. For example, if for some reason one feeding means is not actually performing sheet feeding operations, but the printing drum continues to rotate, the programmed sequence of operations simply continues on, e.g., after the first predetermined number of rotations, the next sheet feeding means begins to feed. Another disadvantage of the known control system is that only alternative operation of the plurality of feeding means can be program-controlled.

SUMMARY OF THE INVENTION

It is a general object to provide a control system for the general type of printing machine in question, in which the control of the plurality of feeding means (and also other means) is performed in such a manner that one feeding means does not commence operation until after a determination has been made that the feeding means operative before it has actually performed its preprogrammed sequence of operations without malfunction. Reliance is not placed upon the assumption that the rotation of the printing drum signifies that the programmed sequence of operations is actually occurring.

Not only the sheet feeding means but other means within the printing machine are controlled in this manner, i.e., the activation of the various means being dependent upon a determination that others of the various means have actually been activated and caused to operate in accordance with the program.

Advantageously, use is made of a programmable control means automatically operative for activating preselectable ones of the various activatable means preselectable numbers of times in preselectable sequences.

Preferably, use is made, to this end, of a plurality of electrical or mechanical counters. These counters keep track of how many times the various activatable means have been activated and performed their respective operations. When the counters determine that various ones of the means have been activated the preselected numbers of times, the counters cause others of the various means to begin to be activated.

According to one concept of the invention, the activations of the card feeding means commence after the preselected number of activations of the sheet feeding means have been determined to have occurred; alternatively, these activations of the feeding means could occur directly, i.e., without interlock.

According to another concept, the diverting means which diverts printed whole-page sheets to the delivery station directly and which diverts printed smaller-format cards into a branch path containing a turnover arrangement, is activated in automatic response to activation of the respective feeding means.

According to a further concept, the various whole-page sheets and smaller-format cards are provided with distinguishable routing markings by marking means, and the marking means are controlled by counters which control the number of activations of the sheet and card feeding means.

If the whole-page and linewise or line-group printing modes are implemented using conventional page and lines cams which are alternatively engageable with the counterpressure roller cooperating with the printing drum for the two modes, then the electromagnetic engaging means which engages one cam and disengages the other for a mode changeover is preferably controlled in dependence upon the count on a counter which controls the activations of the sheet feeding means, in accordance with the preestablished program.

If the linewise or paragraphwise printing mode is implemented using a line cam which is intermittently advanced (phase shifted) to cause the counterpressure roller to effect image transfer of different lines from the printing form on the drum to different cards, then the intermittent advancement of the line cam is advantageously controlled in dependence upon the count on a counter controlling the number of activations of the card feeding means, in accordance with the preestablished program.

The programming of the programmable control means is preferably accomplished using interchangeable insertable program storages, for example program plugs, conductor plates, perforated cards, electrical-contact cards, or the like, for connecting together the inputs and outputs of the various circuit stages in the control means and for establishing connections between control circuitry inputs and outputs and electromechanical drive elements for the various activatable means of the printing machine.

According to another concept the printing form on the printing drum is provided with a marking adjoining the last line to be transferred onto a small-format card or slip. This marking is detected, and after such detection the preselected number of printing operations is performed upon this line (or line group) under the control of a counter, whereupon the counter terminates further operation, e.g., of the feeding means then in operation.

According to another concept, means are provided for interrupting or intervening in the program. Advantageously, a manually settable preselector can be set to indicate the point in the program at which the program is to be interrupted. When this point is reached, the continuation of the program is indefinitely delayed, giving the operator an opportunity to manually command the activation of selected ones of the various activatable means in the printing machine, whereafter the operator presses a button, or the like, to cause the program to resume and continue to completion.

Advantageously, the bins which accommodate stacks of sheets and cards are provided with optoelectronic or electromechanical sensors which determine the number of sheets and cards available. If the number of cards and/or sheets is insufficient for the program, a signal is generated to indicate the problem, and the program is prevented from commencing.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
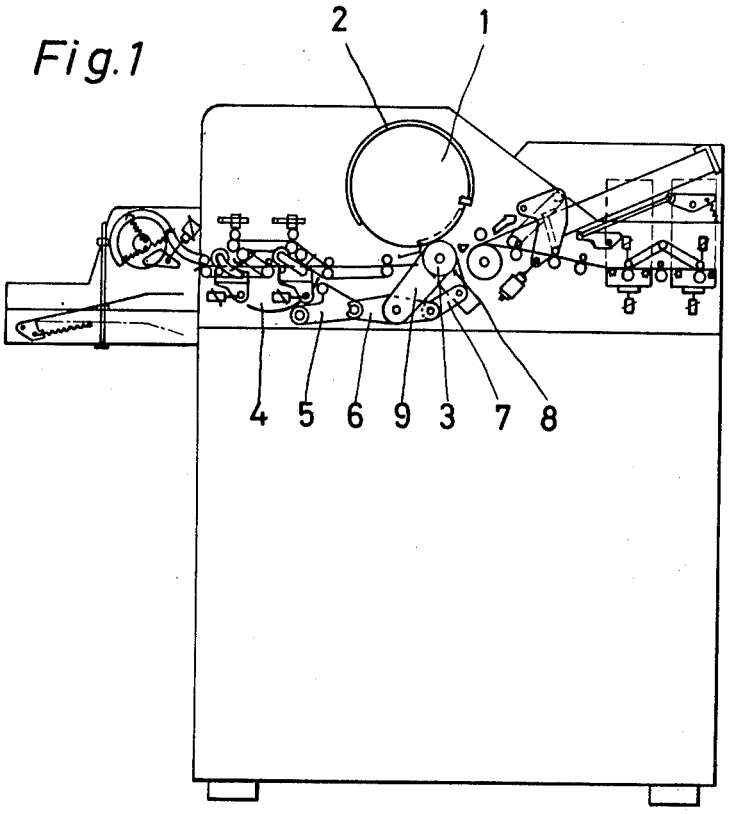
FIG. 1 is a side view of a rotary duplicator machine.

FIG. 1 depicts the printing drum 1 of a rotary duplicator machine, with its printing form 2 mounted in place. Cooperating with the printing drum 1 is a counterpressure roller 3. Roller 3 can be swung against the printing drum under the control of control cams 4 rotating in synchronism with the printing drum, and through the intermediary of levers 5–9, for whole page duplicating, as well as printing of headings and individual lines. In this way, in a manner which is by now well known, it is possible to print page-wise, line-wise or paragraph-wise on the copies, in any desired combination.

Figure 3:
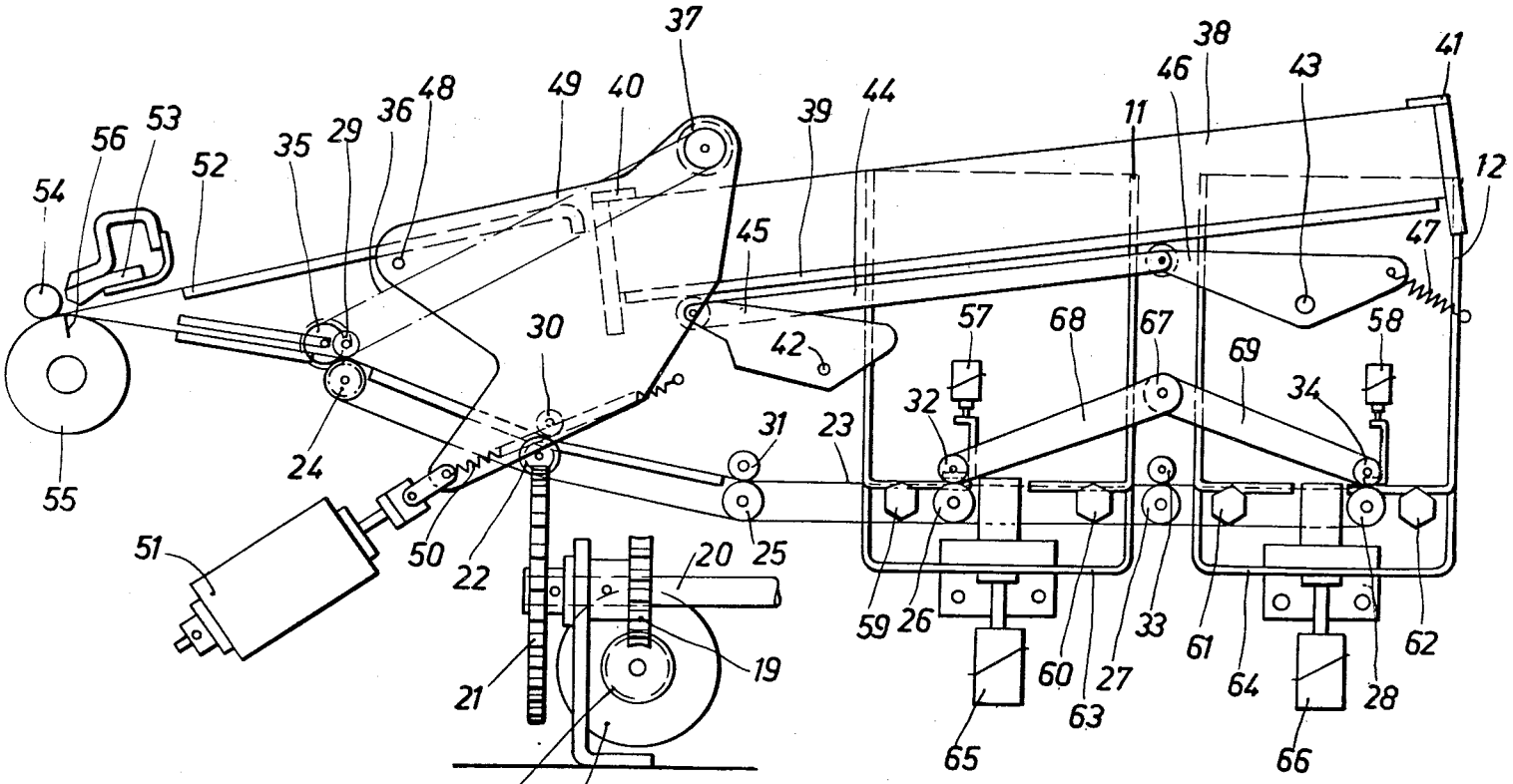
FIG. 3 is a side view of the sheet and card feeding arrangements.
Figure 4:
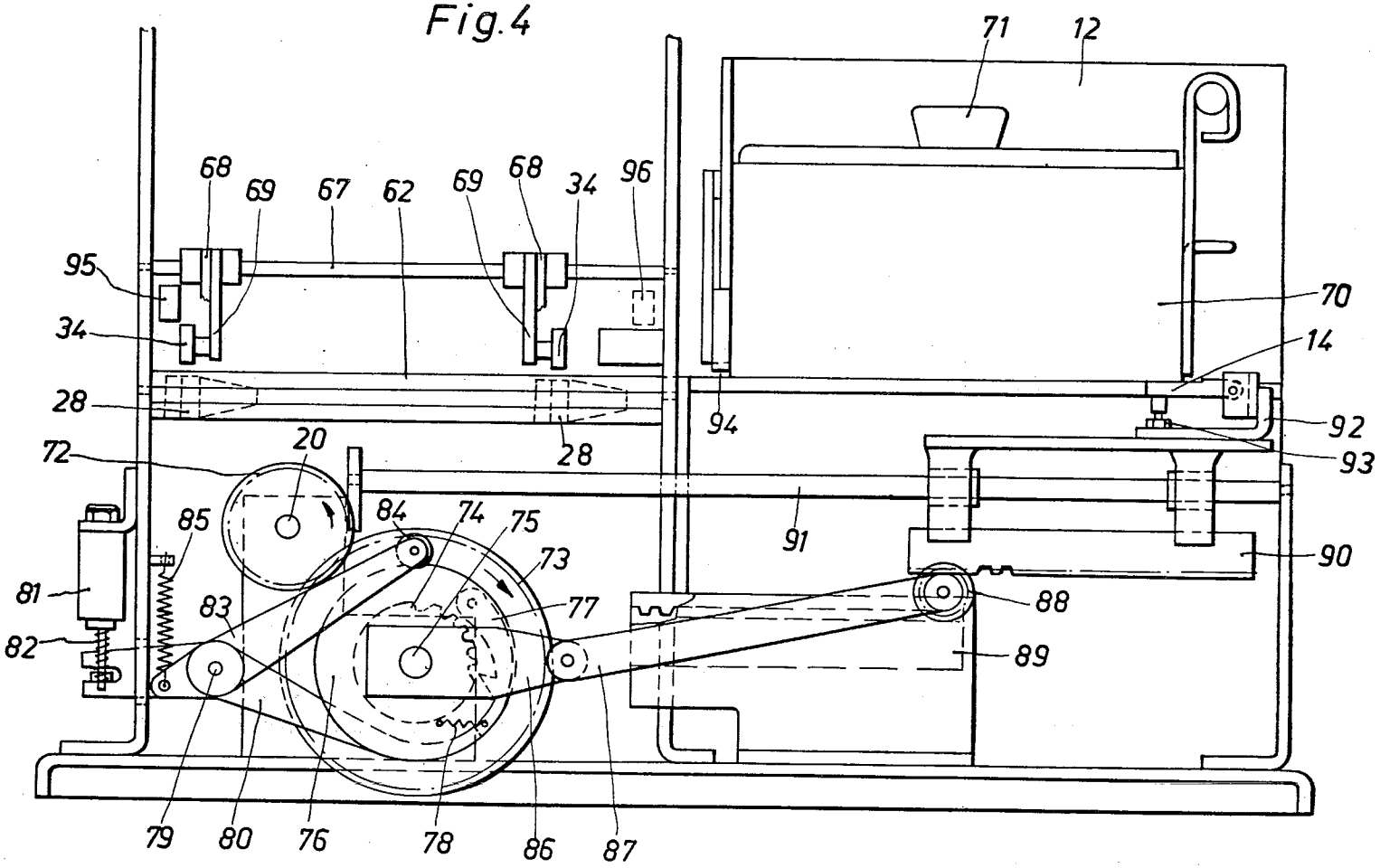
FIG. 4 is a section through one of the card feeding arrangements.
Figure 5:
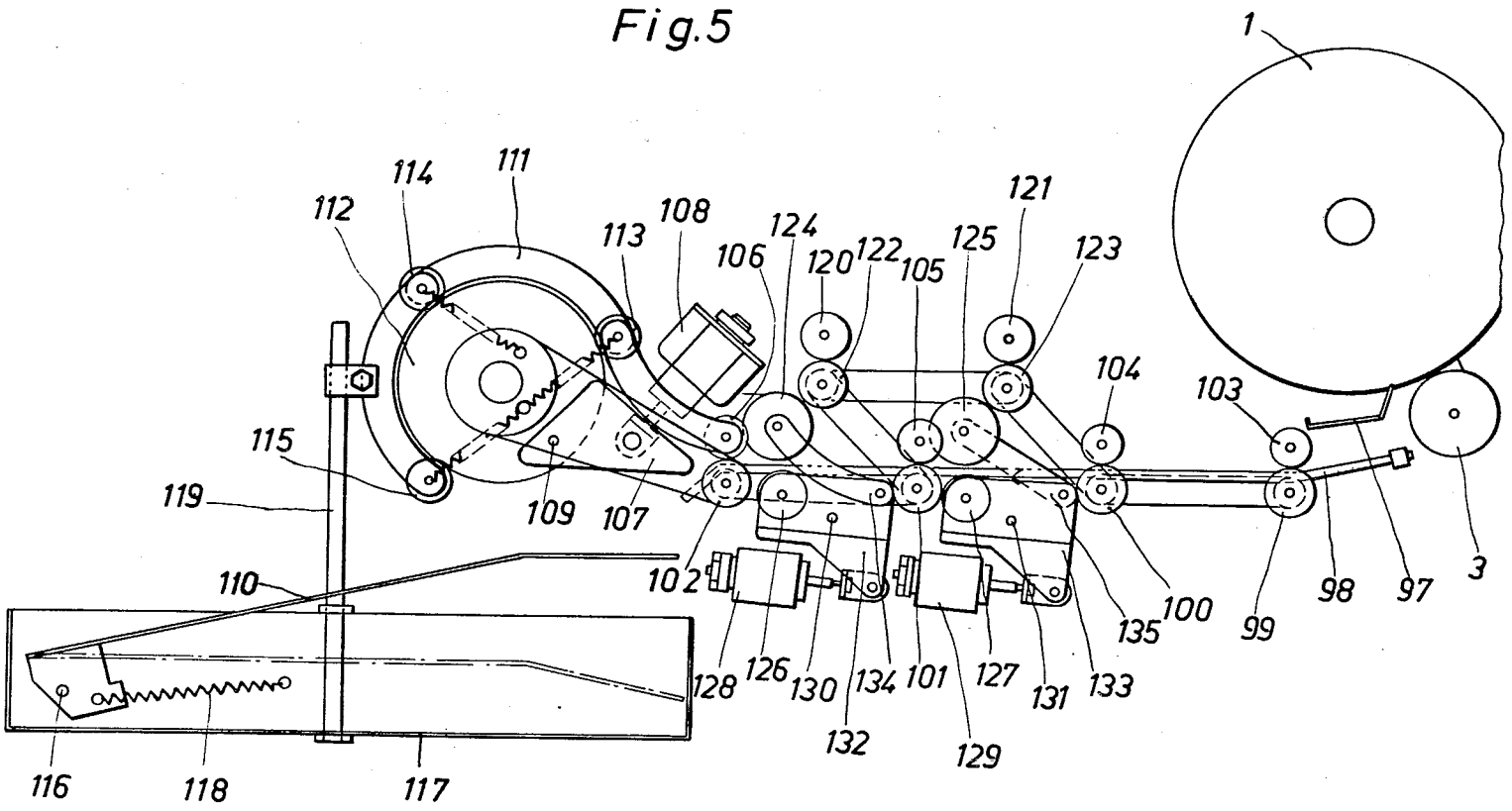
FIG. 5 depicts the outfeed transport arrangement.
Figures 6, 7:
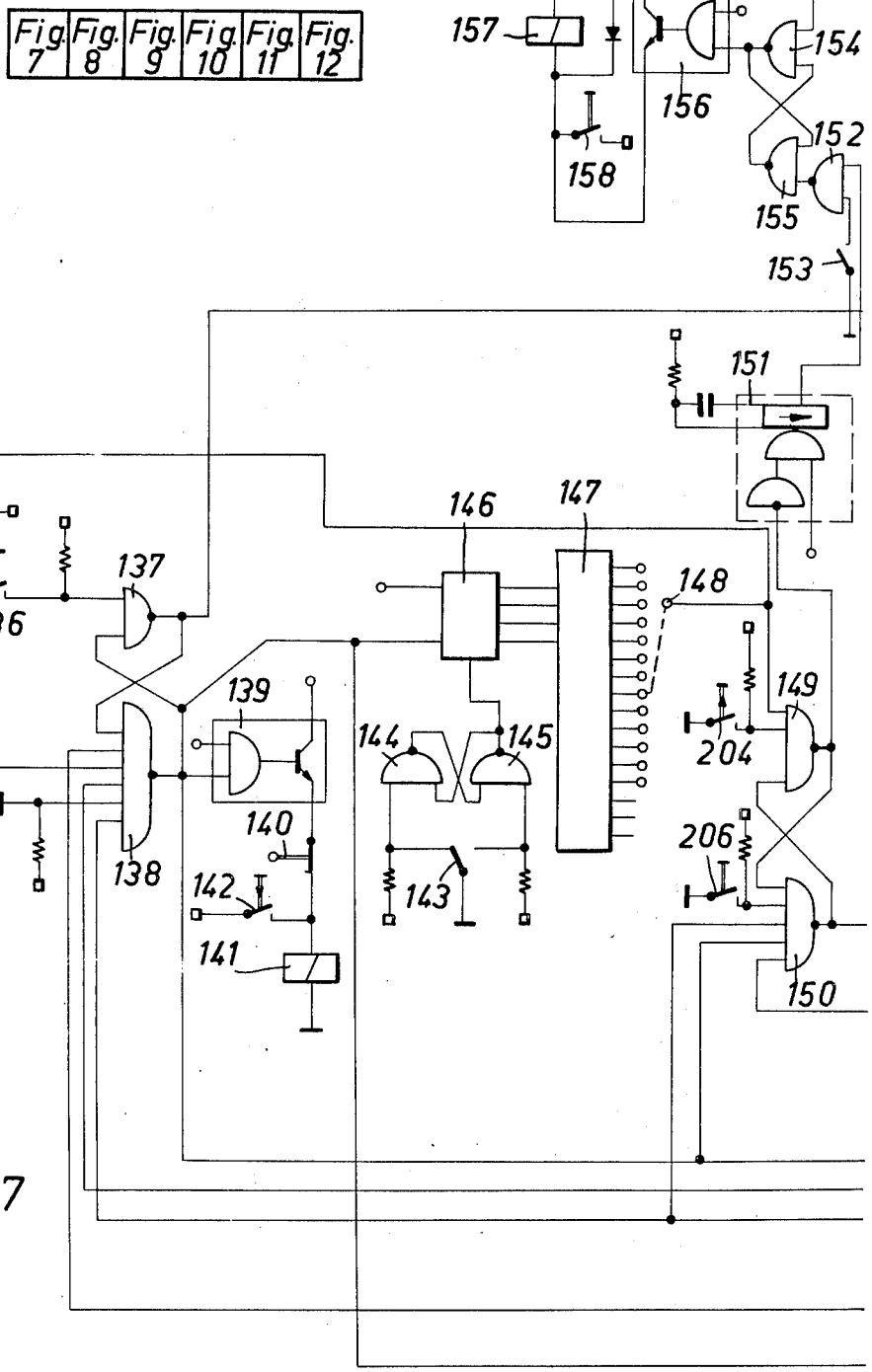
FIG. 6 symbolically indicates the relationships of FIGS. 7–12, one to the next.
FIG. 7–12 together depict an illustrative control circuit.

To the right of the image-transfer location between printing drum 1 and counterpressure roller 3 there is located the feeding arrangement shown in greater detail in FIGS. 3 and 4; to the left of the image-transfer location is the transport and delivery arrangement shown in greater detail in FIG. 5.

Figure 2:
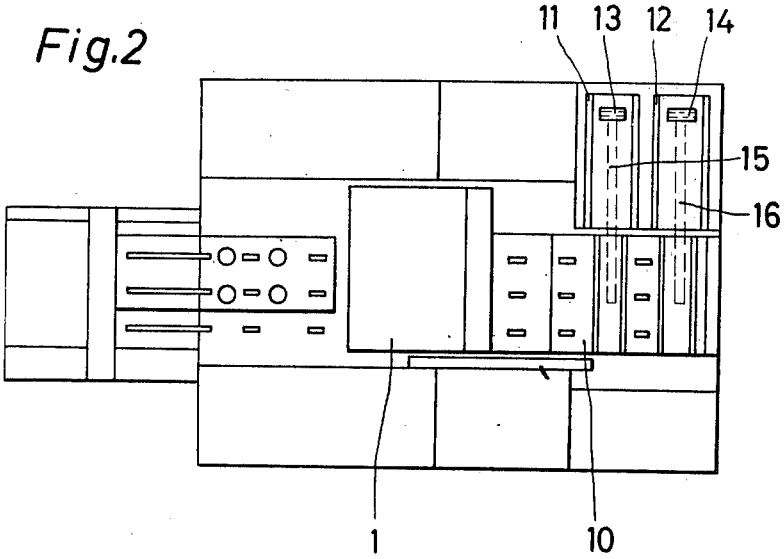
FIG. 2 is a top view of the machine of FIG. 1.

In FIG. 2, the feed table for whole-page sheets has been removed, to expose to view the infeed conveyor 10 for cards. Arranged to the side of the infeed conveyor are two card containers 11 and 12 which each accommodate a stack of cards. Located beneath the stacks of cards are respective card knives 13, 14. These are shiftable along respective guides 15, 16 and serve to move the bottommost card in the respective stack into the infeed conveyor, whereupon the card is transported by the latter to the image-transfer location.

The feeding arrangements shown in FIG. 3 are driven by a common drive motor 17. A shaft 20 is continuously driven by the motor 17, through the intermediary of a worm 18 and a worm wheel 19. A gear 21 mounted on shaft 20 engages with its inclined toothing a further gear 22 which drives a toothed belt 23, so that the latter is continuously in motion. The toothed belt 23, together with further transport rollers 24–28 in engagement with it, as well as with their counterpressure rollers 29–34, forms the infeed conveyor 10 for the cards. The counterpressure rollers 29, 30, 31 and 33 are fixedly journalled, whereas the counterpressure rollers 32 and 34 can be swung away from the transport rollers 26 and 28.

Engaging the teeth of the transport roller 24 is a further gear 35 which continuously drives the friction roller 37 of the sheet feeder, through the intermediary of a toothed belt 36. The whole-page sheets form a stack 38 which is pressed by a spring-biased stacking table 39 against stationary cornering members 40, 41. The stacking table 39 is mounted on two side plates 45, 46 which are pivotable about pivots 42, 43 and connected together by an arm 44. The pressing of the upper edge of the stack 38 against the cornering members 40, 41 is effected by a tension spring 47. The friction roller 37 is journalled at both its ends in side plates 49 which are pivotable about an axis 48. A spring 50 holds the side plates 49 in the illustrated position, in which the friction roller 37 is lifted off the stack 38. Coupled to the side plates 49 is the armature of an electromagnet 51. When the latter is energized, the armature swings the side plates 49 against the force of spring 50 and lowers the friction roller 37 onto the topmost sheet of the stack 38. As a result, this sheet is removed from the stack 38 and fed via a guide plate 52 past a moistening arrangement 53 and through infeed transport rollers 54, 55 to the image-transfer location. Located in the vicinity of the infeed transport rollers 54, 55 is a sensor 56 which is activated by a fed-in sheet or card and initiates one rotation of the printing drum 1 as well as the feeding of the next sheet or card.

During the pushing of a card out of one of the card containers 11 or 12, the counterpressure rollers 32 and 34 are held lifted off by the electromagnets 57 and 58. The card in question slides upon the edges of two hexagonal members 59, 60 or 61, 62. It is moved away by the respective transport roller 26 or 28. Its lateral edges are guided by the inclined upper edges of a liftable and lowerable guide bracket 63 or 64, so that it will be introduced into the infeed conveyor properly oriented. The lifting and lowering of the guide brackets 63 and 64 is effected by electromagnets 65 and 66.

After such a card has been completely pushed out from under the respective stack, a photocell which senses the card activates the electromagnets 57, 58 and 65, 66 in such a manner that the counterpressure rollers 32, 34 — mounted on arms 68, 69 pivotable about an axis 67 — are pressed against the transport rollers 26 and 28; simultaneously, the guide brackets 63 and 64 are moved out of the infeed path, so that the card can be fed via the individual transport roller pairs to the image-transfer location. The card in being so conveyed triggers the sensor 56 and thus initiates the feeding of the next card.

FIG. 4 depicts the drive arrangement for the card knife 14. The latter, when it performs a leftward movement out of its illustrated position, pushes the lowermost card in the stack 70 out of the card container 12 into the infeed path 10. The stack 70 is loaded in per se conventional manner by a weight 71. The right side wall of the card container 12 can be swung upward for the introduction of a new stack of cards into the container.

The card knife 14 is driven via a gear 72 mounted on the continuously rotating shaft 20. Fixedly coupled to gear 73 is a ratchet wheel 74 which, accordingly, turns continuously. A pawl 77 is mounted on a disk 76. Disk 76 is mounted on the same shaft 75 as the ratchet wheel 74 but is rotatable relative thereto. A spring 78 urges the pawl 77 in a direction which would bring it into engagement with the ratchet wheel 74. However, this is prevented by a blocking lever 80 swingably mounted on a shaft 79. However, if an electromagnet 81 is energized, blocking lever 80 is caused to swing and release the pawl 77, so that the latter under the force of spring 78 engages the ratchet wheel 74. As a result, the disk 76 becomes coupled to the ratchet wheel 74 and turns with the latter. After one full rotation, the pawl 77 is again engaged by blocking lever 80; during the rotation in question, blocking lever 80 will have already been returned by a spring 82 back to its illustrated position, inasmuch as its associated electromagnet 81 is energized only briefly. As a result, the pawl 77 is lifted away from the ratchet wheel 74. Accordingly, in response to each brief energization of electromagnet 81, the disk 76 performs one rotation. In order that the disk 76 between the rotations thereof always assume a predetermined angular position, it is provided with an indentation which is engaged by a roller 84 mounted on a lever 83 when the disk 76 is not in motion. The roller 84 is pressed against the disk 76 by a tension spring 85.

Fixedly connected with the disk 76 is a side plate 86 which is articulately connected to a crank rod 87. Provided on the other end of crank rod 87 is a rotatably mounted gear 88 which engages a stationary rack 89 and a horizontally shiftable rack 90. Rack 90 is shiftably mounted on a guide rail 91 and is fixedly connected to the carriage 92 for the card knife 14, so that the card knife 14 will follow the shifting motion of rack 90. The card knife 14 is pivotably mounted on the carriage 92. An adjustment screw 93 is provided for bringing this end of the knife to any desired height.

When the disk 76 performs one rotation, the gear 88 is moved leftward by means of the side plate 86 and the crank rod 87 during the first half of the rotation, and then during the second half of the rotation is moved rightward back into the illustrated position. The displacement of the rack 90 and accordingly of the card knife 14 is thus twice as great as that of the gear 88. This displacement is sufficient to convey the bottom card of stack 70 through a slit 94, whose thickness corresponds approximately to that of a card, completely out of the card container 12 and into the infeed conveyor. The illustrated crank drive has the advantage that the displacement of the card knife 14 does not start and stop abruptly; instead, during the initial part of each such displacement the knife accelerates, and during each terminal phase it decelerates with a braking action.

Located at the left side of the infeed conveyor is a photoelement 95 including a light source and a phototransistor. The photoelement responds to the appearance of a card in the infeed path and effects energization of the electromagnets 58 and 66, causing the counterpressure rollers 34 to press the card against the transport rollers 28 and causing the guide bracket 64 to be simultaneously lowered. There is additionally provided, but not shown in FIG. 4, a counting arrangement which is activated by the photoelement 95; it is used for counting purposes during automatic duplicating operation.

Two photoelements are employed for the cards ejected from the card container 11. One photoelement, which effects the energization of the electromagnets 57 and 65, is located to the left of the infeed path in the same way as photoelement 95. However, this photoelement cannot be used to count the cards pushed out of card container 11, because it also detects the cards coming from card container 12 as the latter are transported along the infeed path. For that reason, there is provided in the region of the card container 11 an additional photoelement 96 located to the right of the back edge of a pushed-out card. It is activated only during the pushing out of a card from the card container 11, and does not detect cards which have in their entirety already entered the infeed path. Except for the photoelement 96, there is no difference between the arrangements which remove the cards from the two card containers 11 and 12.

FIG. 5 depicts the transport arrangement for the printed sheets and cards between the printing drum 1 and the outfeed arrangement. During the transport of the sheets and cards to the outfeed arrangement, they can be provided with different colored markings corresponding to their intended use or meaning. A turn-over station is provided for the cards, at which they are turned over so that each individual card is laid with its printed side upon the preceding card. In this way, the cards are made available in the same sequence in which they have been printed.

A stripper 97 removes the sheets or cards from the printing drum 1 and transfers them to the transport arrangement. The latter includes a guide channel 98, continuously driven transport roller 99–102, and counterpressure rollers 103–106. Located at the end of the guide channel 98 is a guide plate 107 which is swingable about an axis 109 by an electromagnet 108. When electromagnet 108 is energized, the end of guide plate 107 which faces guide channel 98 is pulled upward, so that the transported sheets or cards will be deposited directly onto the outfeed plate 110. However, the electromagnet 108 is controlled in such a manner that only whole-page sheets are deposited in this way. The electromagnet is not energized when cards are being transported; instead, the guide plate 107 stays in the illustrated position. The arriving cards are fed between a bracket 111 and a continuously driven roller 112. The transport of the cards about the roller 112 is effected by means of counterpressure rollers 113, 114, 115 which project through the bracket 111 and lie spring-biased upon the roller 112. In travelling about the roller 112 the cards are turned over, and they are deposited one after the other with their printed sides downward upon the outfeed plate 110. The swinging movement of the outfeed plate is performed about a stationary shaft 116 in a delivery bin 117. A tension spring 118 lifts the free end of the outfeed plate 110 out of the delivery bin 117. However, as the number of discharged cards and sheets increases, the outfeed plate 110 lowers, so that the upper side of the accumulating pile always remains at approximately the same level.

The delivery bin 117 can be swung about a shaft 119 to facilitate removal of the pile of discharged sheets and cards. To facilitate sorting of the printed cards or sheets, these can be provided with colored markings on their printed sides. To this end, there are provided in FIG. 5 two felt rollers 120, 121 inked with inks of different color. Ink from rollers 120, 121 is transferred via continuously rotating transfer rollers 122, 123 onto two printing rollers 124, 125. The printing rollers 124, 125 and their opposing counterpressure rollers 126, 127 are normally located outside the guide channel 98, so as not to come into contact with the sheets or cards being transported through the guide channel 98. Associated with each roller pair 124, 126 and 125, 127 is a respective electromagnet 128 or 129. There electromagnets move pivotable mounting plates 132 and 133. The counterpressure rollers 126 and 127 are mounted directly in the respective mounting plates 132 and 133, whereas the printing rollers 124 and 125 are connected to the latter by means of respective brackets 134 and 137. Upon energization of electromagnet 128, for example, the mounting plate 132 pivots about the pivot 130, and the printing roller 124 moves downward and the counterpressure roller 126 upward into the guide channel 98, to provide a colored marking upon a card or sheet travelling through the guide channel. If desired, the individual cards and sheets could be provided with a plurality of colored markings.

FIGS. 7–12 depict a circuit for implementing automatic operation of a rotary duplicator machine. FIG. 6 schematically indicates that FIGS. 7–12 are to be understood to be continuations of one another, and together form a single circuit diagram.

The sequence of operations which will be described with reference to FIGS. 7–12 relates, to a great extent, to setting up the control system of the rotary duplicator for a particular job. It will be assumed that whole-page sheets and also differing types of cards are all to be printed upon in the course of the job. The cards to be printed include both so-called stock cards and so-called work cards. Cards which are of the same type and also identically printed are to be provided with differing colored markings, to indicate their destinations or purposes. To effect transfer of different portions of the image on the printing form to successive sheets and cards, use is made of conventional control cams which rotate in synchronism with the printing drum and cause the counterpressure roller to be swung against the printing drum to effect transfer to the selected portions of the image onto the sheets and cards. Transfer of the entire image on the printing form onto whole-page sheets is effected by activating the so-called duplicator cam; the so-called heading and line cams are employed to effect transfer to a sheet or card of one or a plurality of lines from the heading on the printing form and to effect transfer of one or a plurality of lines from the body of the text on the printing form.

For example, the image on the printing form 2 may consist of a complete specification of a quantity of items ordered by a customer. The heading may be constituted by information identifying the customer by name, address, account number, and the like, and may include information indicating promised date of delivery, and so on. Also, the heading may include the product designation (e.g., model number), the number of units ordered, and the material to be used (e.g., a particular metal). Beneath the heading may be a list of work steps, each work step being written on a successive line. For example, the first work step line may include a description of the first operation to be performed upon a workpiece using a first machine tool, the operator who is to perform the first work step, and an accounting code number to be used for subsequent customer billing and piece-work payment for the machine tool operator. The second work step line would, then, include a description of the second operation to be performed upon the workpiece, for example by a second operator using a second machine tool; and so forth. The text on the printing form 2 may also include workpiece information lines, specifying the workpiece types to be used in the work steps, if more than one type is involved.

Assuming this situation, it will be in general desired to first produce a certain number of whole-page copies of the entire text on the printing form 2. These may be routed, for example, to various clerical departments. Thereafter, it will be desired to print a plurality of stock cards. Printed onto each stock card will be one or more lines from the heading; printed onto successive ones of the stock cards will be successive ones of the workpiece lines on the printing form, it there is more than one workpiece line in the text, or else just the one workpiece line on one stock card. In either event, a plurality of identical stock cards will in general be printed for each workpiece line of the text, and these will be routed to different departments, such as inventory. Finally, to be produced are the work cards, Each work card is printed with one or more lines from the heading, plus a respective one or ones of successive work step lines from the text on printing form 2, plus also the relevant workpiece line or lines. Thus, each stock card will bear information identifying the order, the workpiece employed and the working step to be performed by a particular operator on a particular machine tool. In general, a plurality of identical work cards will be printed for each work step line in the text; these will be differently routed, for example one to the machine tool operator, himself, another to the accounting department for calculating the operator's piecework pay, and so forth. It is to be understood that this explanation is illustrative only.

The program to be described can be altered in a large number of ways by manual intervention.

The programmed sequence of printing operations is initiated by pressing a start switch 136. This effects a change of state of a flip-flop comprised of NAND-gates 137 and 138; the flip-flop activates an amplifier 139. Through the intermediary of a closed switch 140, a relay 141 becomes energized, applying voltage to the electromagnet 51 (FIG. 3), and thereby effecting the feeding of a sheet from the stack 38. The sheet conveyed to the infeed transport rollers 54, 55 activates the sensor 56, which triggers a printing drum rotation. Immediately after the printing drum begins to rotate, the switch 140 opens; it remains open until the printing drum has returned to its starting position. Only then can the next sheet be removed from stack 38 and fed to the duplicator machine. By means of a switch 142, the machine operator can manually command the infeed of a sheet, independently of the pre-established program.

A contact 143 of relay 141 is switched over each time relay 141 is energized, thereby effecting a change of state of flip-flop 144, 145, the output pulses from which are applied to a binary counter 146. However, counting of the fed-in sheets is performed by the binary counter 146 only when the flip-flop 137, 138 is in a predetermined one of its two states, i.e., the counter 146 does not count sheets fed in as a result of manual closing of switch 142. Connected to the outputs of the counter is a decoder 147; the decoder is so designed that only one of its outputs carries a signal at any given time, and which of the outputs is carrying the signal is indicative of the count on counter 146. A terminal 148 is connected to that one of the decoder outputs corresponding to the desired number of whole-page sheets to be fed in; this connection may be established, for example, by a rotary dial, by a punched tape or card, or the like. When the binary counter 146 reaches the preselected count, the signal transmitted to terminal 148 effects resetting of the flip-flop 137, 138 and accordingly prevents further operation of the whole-page sheet feeder; additionally, the signal at 148 effects a change of state of a flip-flop 149, 150, which latter controls the operation of the feeder for stock cards. This change of state of flip-flop 149, 150 additionally triggers a monostable circuit 151, which responds by applying a pulse to one input of a NAND-gate 152; this pulse lasts at least until the just-initiated printing drum rotation has been completed. Shortly before the printing drum has returned to its starting position, a switch 153 closes, thereby setting a flip-flop 154, 155, and the latter via an amplifier 156 effects energization of a relay 157. Energization of relay 157 deactivates the whole-page duplicator cam, and causes the heading and line cams to begin to control the operation of the counterpressure roller. This changeover of the control cams can also be commanded manually, by closing pushbutton switch 158.

Figure 8:
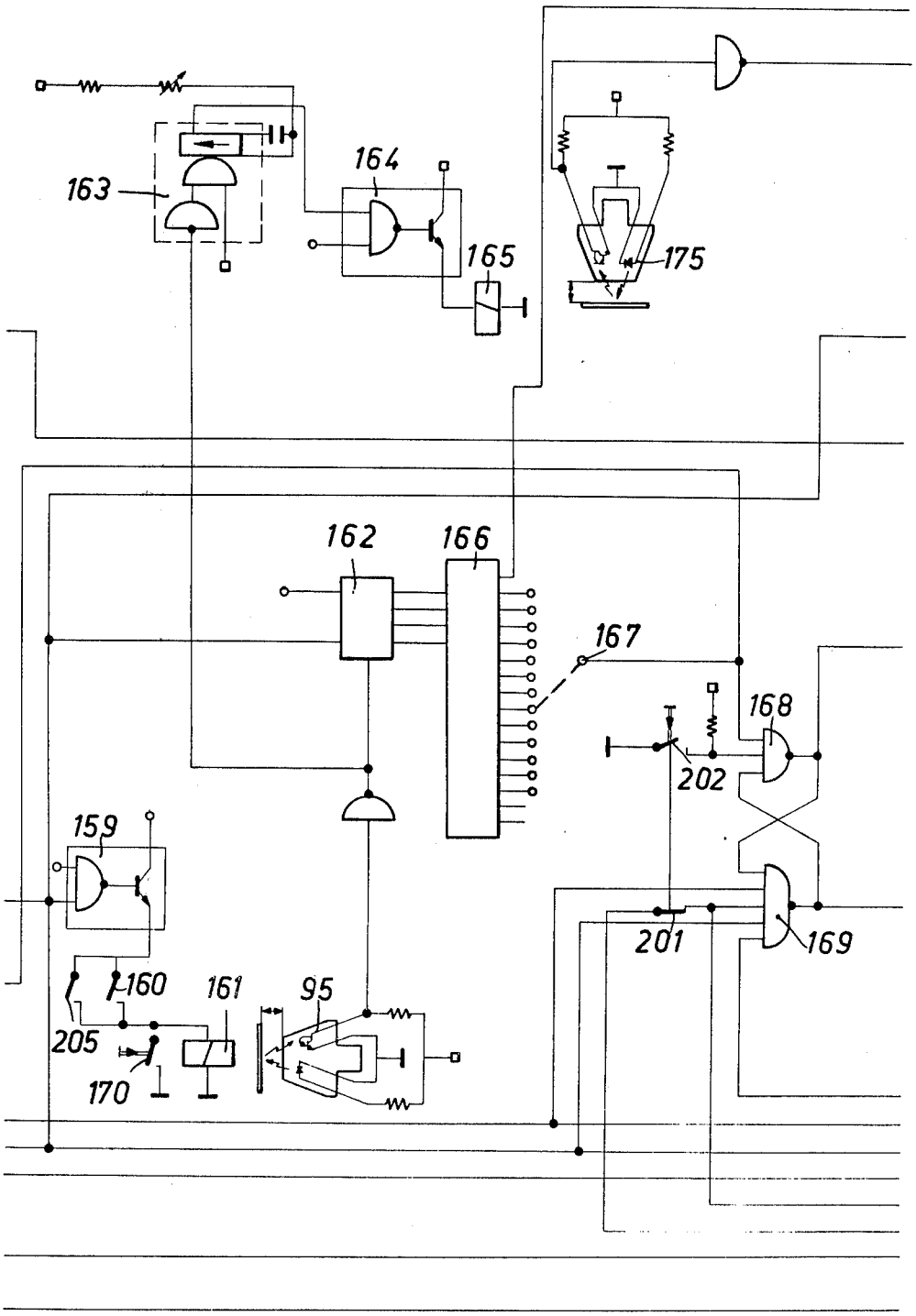
Figure 9:
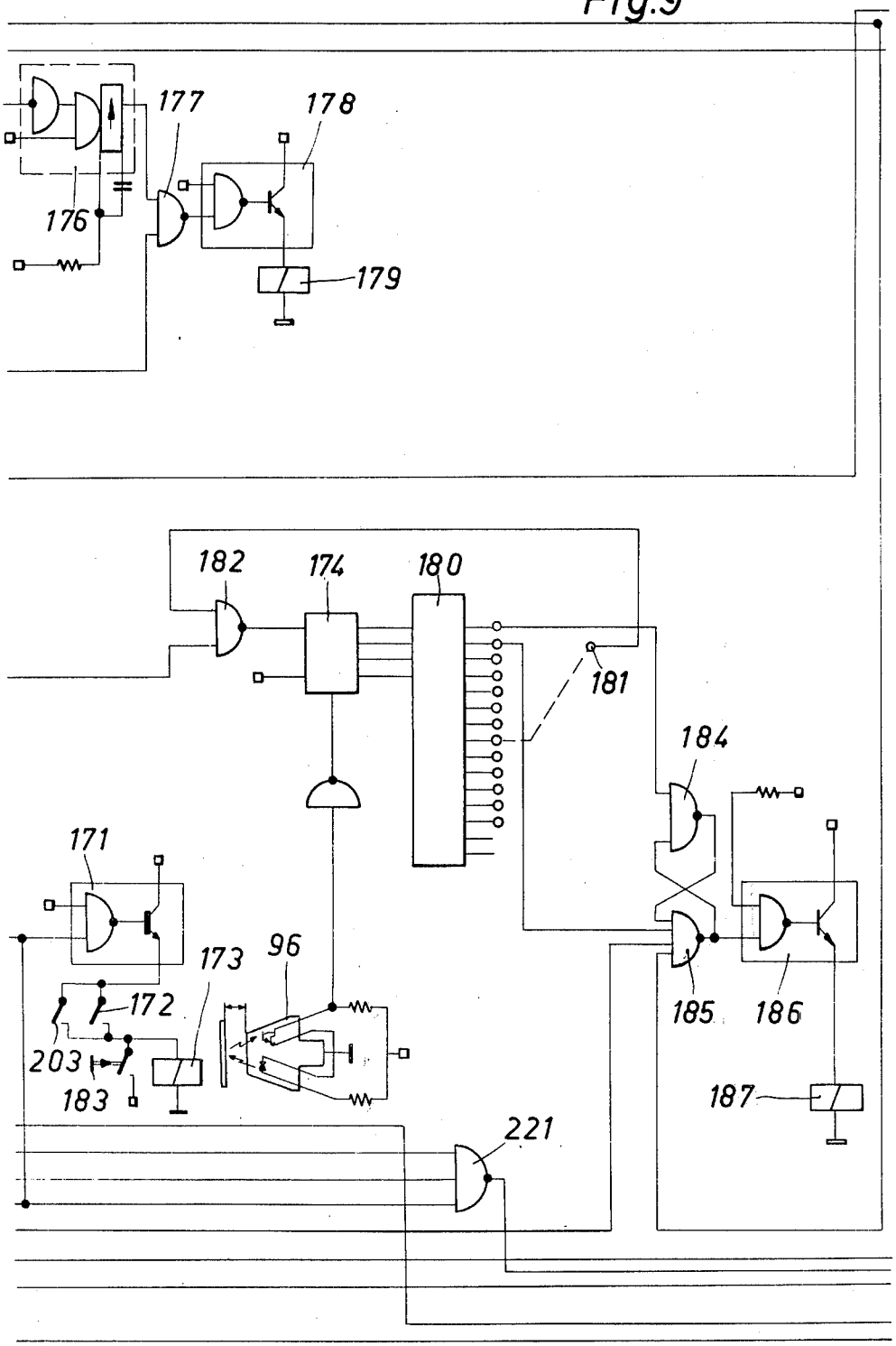

The flip-flop 149, 150, when triggered by the signal from the preselected output of decoder 147, activates an amplifier 159 (FIG. 8). Amplifier 159 together with a switch 160 which briefly closes once per printing-drum rotation energizes a relay 161. Relay 161 connects the electromagnet 81 (FIG. 4) to voltage, and thus initiates ejection of a stock card from the card container 12 into the infeed path 10. The ejected card is detected by the photoelement 95; the photoelement includes a light-emitting diode and a phototransistor which receives light reflected from the card. The resultant output pulse from photoelement 95 is applied to a binary counter 162 and to a monostable circuit 163. The monostable circuit 163, via an amplifier 164, energizes a relay 165 which controls the electromagnets 58 and 66 (FIG. 3) and accordingly effects lowering of the guide bracket 64 and also the transport of the stock card into the infeed conveyor.

Connected to the output of binary counter 162 is a decoder 166 similar to the decoder 147 already mentioned. Here likewise, the preselection of the number of stock cards to be fed can be effected by connecting a corresponding decoder output to a terminal 167, for example by a rotary dial, a punched tape or card, or the like.

When the binary counter 162 reaches the preselected count for stock cards, the signal appearing on terminal 167 resets flip-flop 149, 150, preventing further feeding of stock cards. Simultaneously, a flip-flop 168, 169 becomes set; this flip-flop controls the feeding of stock cards.

The feeding of stock cards, likewise, can be manually commanded by closing a pushbutton switch 170. However, as before, manually commanded infeed of stock cards has no effect upon the count on counter 162.

Flip-flop 168, 169, when set by the signal at terminal 167, activates an amplifier 171 which causes a relay 173 to be connected to voltage, via a switch 172 which like switch 160 is briefly closed once per printing drum rotation. As a result, an electromagnet corresponding to electromagnet 81 (FIG. 4) is energized, so that a work card will be ejected from the card container 11. During the pushing out of this work card, the latter is detected by The photoelements 96, which applies a pulse to a binary counter 174. A further photoelement 175, located downstream of photoelement 95 (as considered in the direction of the infeed transport path), is activated when the work card in question has been completely ejected from the card container 11. A relay 179 becomes energized, via a monostable circuit 176, a NAND-gate 177 and an amplifier 178. The relay 179 controls the electromagnets 57, 65 (FIG. 3) in such a manner that the counterpressure rollers 32 press the ejected work card against the transport rollers 26, while simultaneously the guide bracket 63 is moved down out of the infeed transport path. The second input of the NAND-gate 177 is connected with the output of the flip-flop 149, 150. As a result, when flip-flop 149, 150 is set — i.e., during the infeed of stock cards — the counterpressure rollers 32 are in uninterrupted engagement with the transport rollers 26 and the guide bracket 63 is in a position retracted out of the infeed transport path. This assures a trouble-free transport of the stock cards along the infeed transport path.

A decoder 180 is connected to the outputs of the binary counter 174. The number of work cards desired for each work step line or line group is preselected by connecting the corresponding output of the decoder 180 to a terminal 181, again bey means of a rotary dial, punched card, or the like. When the binary counter 174 has registered the preselected number of work cards, the signal appearing on terminal 181 and transmitted via NAND-gate 182 resets the binary counter 174. NAND-gate 182, which is also connected to the output of flip-flop 168, 169, prevents the counter from counting work cards whose infeed has resulted from manual activation of the program-intervention switch 183.

Each time the binary counter 174 becomes reset, the resultant signal at the first output of decoder 180 sets a flip-flop 184, 185 which, via an amplifier 186, effects energization of a relay 187. As a result, the line cam controlling the movement of the counterpressure roller of the duplicator machine is advanced, as preprogrammed, one, two or three work step lines, so that the next work card to be fed, besides heading and workpiece line, will also be imprinted with one or more work step lines corresponding to the setting of the line cam. When the binary counter 174 has registered the first one of the subsequently fed work cards, the signal at the second output of decoder 180 resets the flip-flop 184, 185. The latter can be set again upon the next resetting of binary counter 174 and thus trigger a further advancement of the line cam. A succession of work cards are now printed with the same work step line(s) until the output of decoder 180 connected to terminal 181 produces a signal. At that time, the binary counter 174 becomes reset and the line cam is advanced another step or steps. In this way, the preselected number of work cards are printed all having the same work step lines.

The programmed sequence of operations being described is to end after the printing of the last work step line or lines of the printing form, or if desired before the last line or lines are reached. To this end, a marking is provided on the printing form 2 at the level of the last work step line to be copied, after which the program is to terminate. This marking is sensed by a photoelement 188 (FIG. 11) once per rotation of printing drum 1. Connected in series with photoelement 188 is an optical switch 189 whose through-pass intervals are dependent upon the setting of the line cam. Only when the setting of the line cam corresponds to the printing-form work step line provided with the end-of-program marking, is there coincidence between the pulses generated by photoelement 188 and the through-pass intervals of the optical switch 189. However, the termination of the program should not actually occur until the preselected number of work cards imprinted with the last work step lines have actually been produced. For this reason, use is made of a binary counter 190 operative for counting the number of printing-drum rotations occurring during printing of the printing-form work step line or lines with which the end-of-program marking is associated. The outputs of the binary counter 190 are connected to the inputs of a NAND-gate 191 in such a way, that the latter undergoes a change of state when the preselected number of work cards imprinted with the last work step lines have actually been produced. The output signal from NAND-gate 191 is applied to the input of flip-flop 168, 169, which only then becomes reset and prevents further infeed of work cards.

Figure 12:
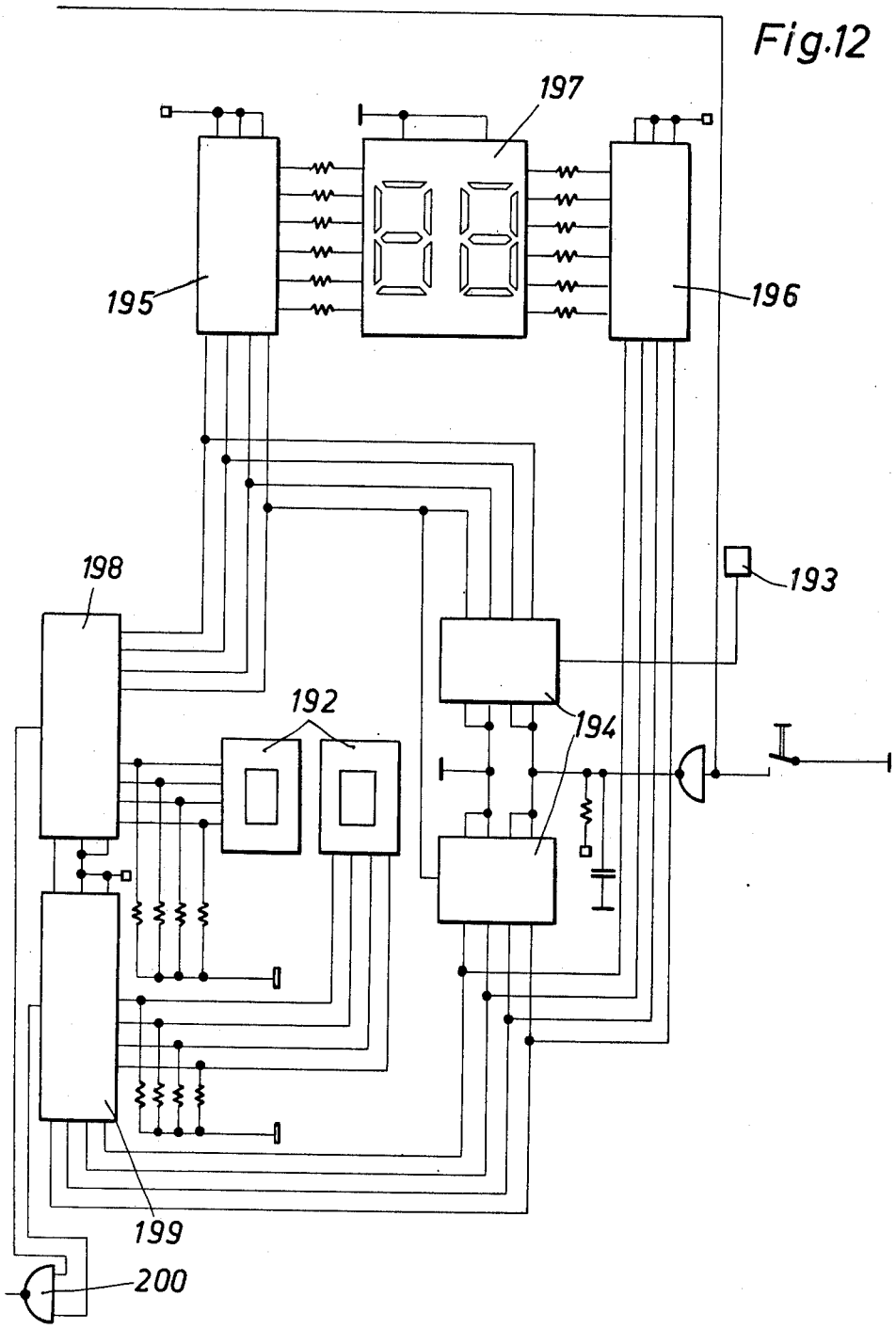

With the program under discussion, successive sets of work cards can be produced, the number of cards in each set being the same, and the individual cards of any one set all being imprinted with the same work step lines. However, it may happen that a larger number of work cards imprinted with certain work step lines or line groups are required. The part of the circuit shown in FIG. 12 is provided for this purpose.

This part of the circuit includes a preselector counter 192 having two decimal-system places upon which the line-number of the work step line in question can be preset; this line-number identifies the particular work step line which is to be imprinted upon a number of cards different from the number of cards upon which the preceding work step lines have been imprinted, and/or the particular work step line after which the work step lines are to be imprinted upon a number of cards different from the number of cards upon which the preceding work step lines have been imprinted. A pulse generator 193 is controlled in dependence upon the intermittent advancement of the line cam in such a manner that, each time the line cam is advanced a step corresponding to one line-spacing on the printing form, the pulse generator 193 applies a pulse to a binary counter 194; the latter has a two-place capacity in the decimal system.

A display 197 is connected to the outputs of the binary counter 194 via two decoders 195, 196, and during the course of the programmed sequence of operations provides a continual indication of which work step line on the printing form is being printed. The corresponding outputs of the preselector counters 192 and of the binary counter 194 are connected to the inputs of respective inputs of two comparators 198, 199. When the two counts applied to these comparators correspond, the pulse appearing at the outputs of the two comparators is applied, via a NAND-gate 200 and a closed switch 201 (FIG. 8) to one input of flip-flop 168, 169. The latter becomes reset and prevents further automatic infeed of work cards. Simultaneously, the flip-flop 184, 185 becomes reset, since its resetting can no longer be effected via the second output of decoder 180. The binary counter 174, too, becomes reset. The program having been thusly interrupted, the pushbutton switch 183 is manually depressed to effect infeed of the desired number of work cards for the preselected work step line in question. Thereafter, the pre-established program resumes. This is effected by activating a button which effects simultaneous brief closing of two switches 202, 203 and opening of switch 201. Flip-flop 168, 169 becomes set, energizing relay 173 via amplifier 171 and switch 203, resulting in infeed of a work card, which in turn triggers a printing-drum rotation. From this point, the pre-established program continues to completion.

The program can be started directly with work card infeed by activating the switches 201, 202, 203 instead of the start button 136. Likewise, the program can be started with the infeed of stock cards by not activating start button 136 but instead a button which simultaneously closes the two switches 204, 205 and accordingly initiates the automatic infeed of stock cards. If only the duplication of the entire heading and text on the printing form 2 onto whole-page sheets is desired, then switch 206 can be closed to entirely skip the infeed of stock and/or work cards.

Figure 10:
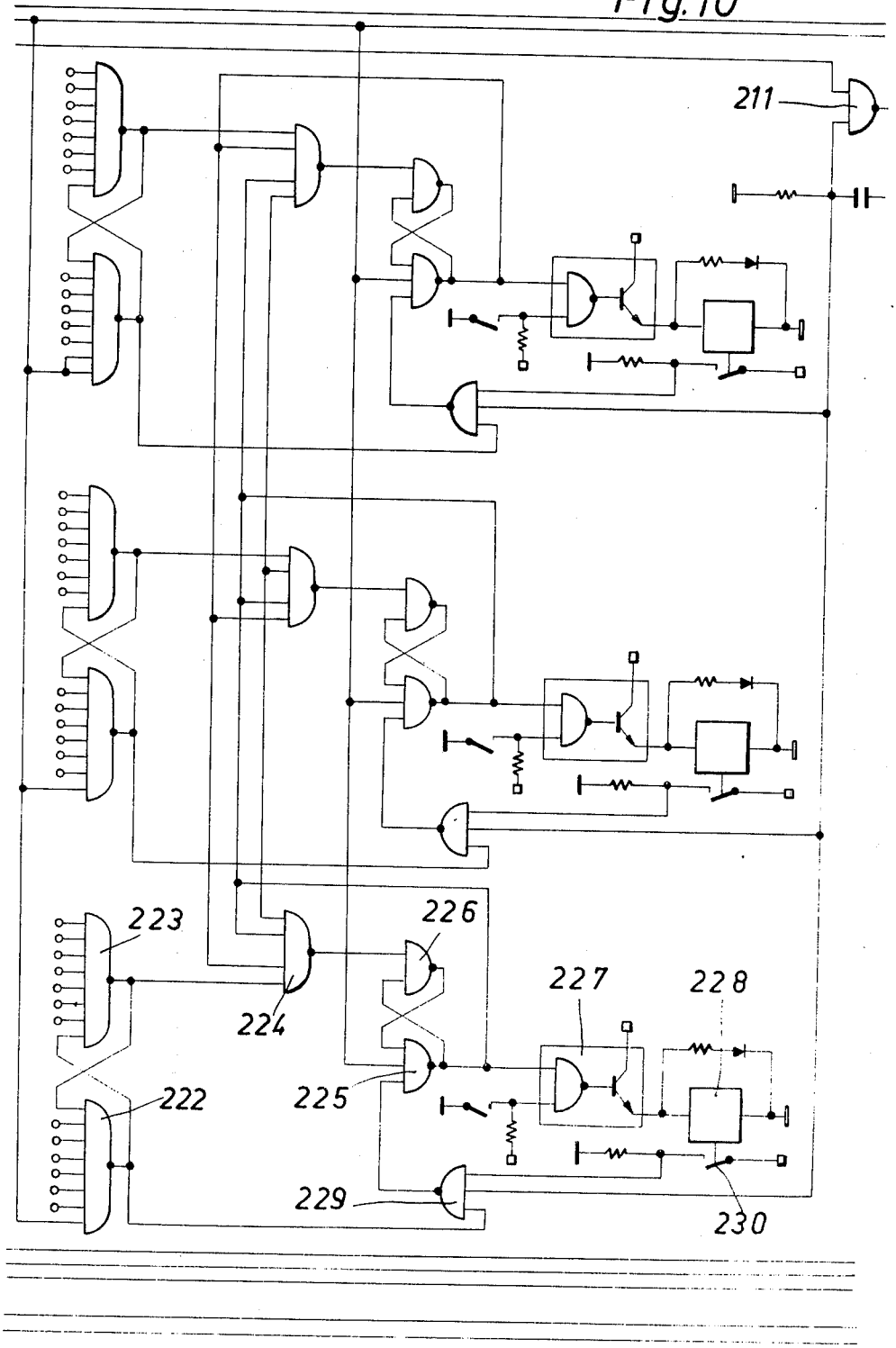
Figure 11:
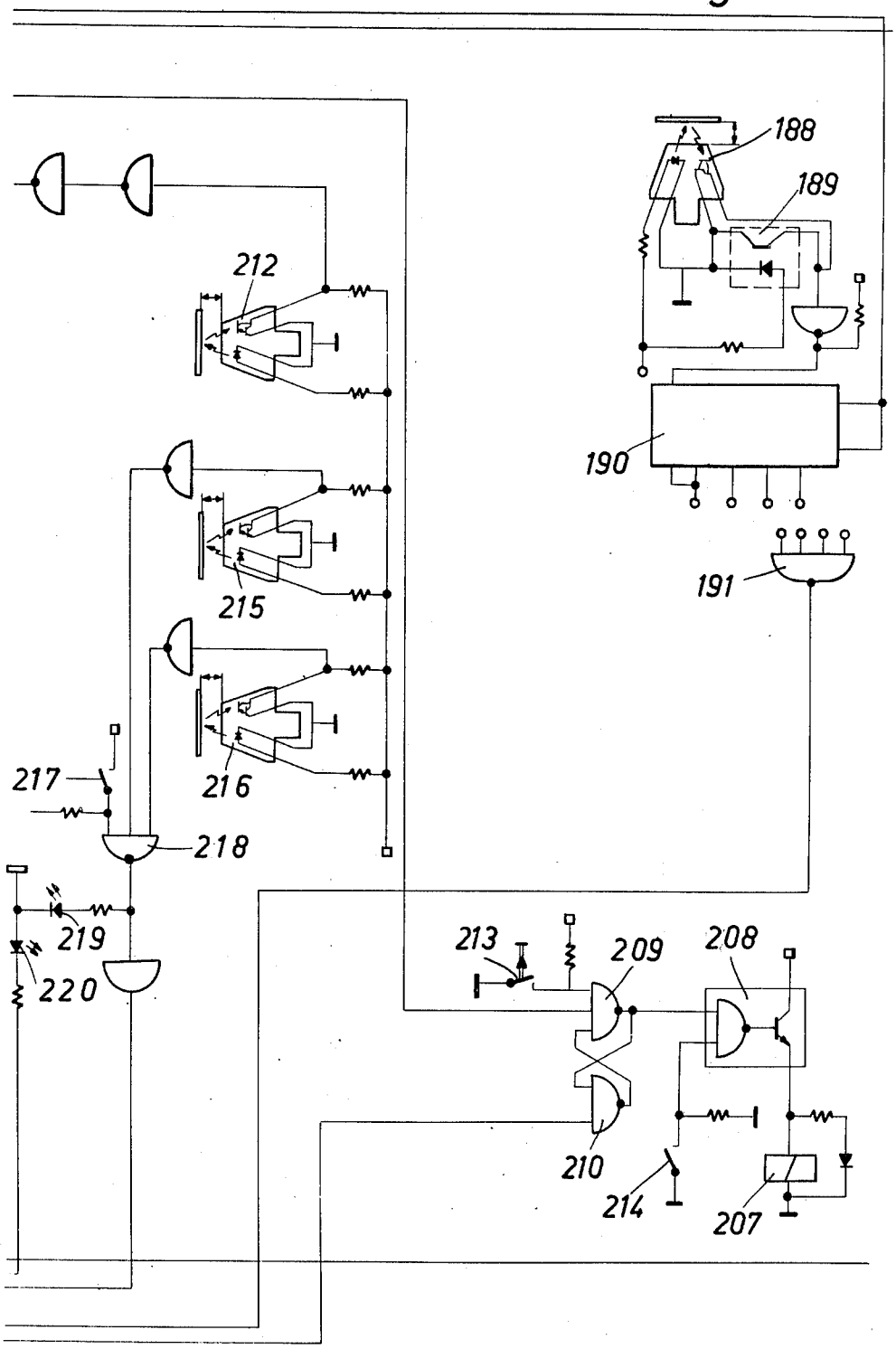

The electromagnet 108 which pivots the guide plate 107 (FIG. 5) is controlled by a relay 207 (FIG. 11). This relay is connected in series with an amplifier 208 which can be activated by a flip-flop 209, 210. During infeed of whole-page sheets, the flip-flop 209, 210 is controlled by the output of flip-flop 137, 138 in such a manner that the amplifier 208 is activated and the relay 207 connected to voltage. The resultant energization of electromagnet 108 causes the guide plate 107 to pivot upward, so that the whole-page sheets will be fed directly onto the outfeed plate 110. When the infeed of cards commences, a pulse is applied from the first output of decoder 166 to one input of a NAND-gate 211 (FIG. 10). The other input of NAND-gate 211 receives a pulse from a photoelement 212, located between the printing rollers (for the colored markings) and the guide plate 107 (FIG. 5); the photoelement 212 detects the transported sheets and cards. The output pulse from NAND-gate 211 resets the flip-flop 209, 210; the electromagnet 108 becomes deenergized and the cards are transported over the roller 112. The resetting of flip-flop 209, 210 can also be effected by two manually activatable switches 213, 214, which are closed simultaneously. This is necessary, for example, if the program is to begin with the immediate infeed of stock cards or work cards.

Prior to commencement of the programmed operations, it is necessary to check that the requisite numbers of sheets and cards are present on the stacking table and in the card containers. To this end, photoelements 215, 216 are provided in the side walls of respective card containers 11, 12, and a microswitch 217 is provided in the stacking table 39. These become activated when the number of cards or sheets present is less than the required number. A signal is furnished via a NAND-gate 218 to one input of flip-flop 137, 138, to prevent the latter from becoming set, and thereby prevent program commencement. Additionally, a light-emitting diode 219 lights up, to indicate the problem.

A further light-emitting diode 220 is energized via a NAND-gate 221 when any one of flip-flops 137, 138; 149, 150; or 168, 169 becomes set. This light-emitting diode indicates that the programmed sequence of operations has commenced. These three flip-flops are interlocked by means of the input lines of NAND-gate 221, to assure that in no event can more than one of these flip-flops assume the set state.

The control means for the marking devices which can provide the sheets and cards with colored markings (indicative of intended purpose or departmental routing) is depicted in FIG. 10. With the arrangement of FIG. 10, the markings can be applied in three different colors. The control of the marking devices for the individual colors is identical, so that it is sufficient to describe that for the marking of one particular color.

Associated with each color is a flip-flop comprised of NAND-gates 222, 223. The flip-flop is set via NAND-gate 223 and reset via NAND-gate 222. To provide one or more colored markings on a certain work card, for example, the corresponding output of decoder 180 is connected with a respective input of NAND-gate 223. Additionally, this output is connected to the reset inputs of the flip-flops for the color(s) not desired, so that for the desired color(s) the associated flip-flop(s) will be set and for the not desired color(s) the associated flip-flop(s) will be reset. Associated with each flip-flop 222, 223 is a respective NAND-gate 224 by means of which a further flip-flop 225, 226 can be set. However, this can occur only if the associated flip-flop 222, 223 is in the set state and, concurrently, all the flip-flops 225, 226 are in the reset state, because the inputs of the NAND-gates 224 are connected with the outputs of all flip-flops 225, 226. After setting a flip-flop 225, 226 or, in the case a plurality of NAND-gates 222 are activated, after simultaneously setting the plurality of associated flip-flops 225, 226, the associated amplifier or amplifiers 227 are activated. Each activated amplifier energizes the associated electromagnet 228, causing the respective printing roller and its counter-pressure roller to be pressed against the work card.

The resetting of the set flip-flop 225, 226 is effected via a NAND-gate 229. To this end, it is necessary that the associated flip-flop 222, 223 be in the set state, that the photoelement 212 located downstream of the printing rollers signal the transport of the work card therepast, and that a switch 230 close signalling that the printing roller and counterpressure roller have been swung into engagement. If in this way all flip-flops 225, 226 are reset, the flip-flops 222, 223 set by the signal at the next output of decoder 180 can set their associated flip-flops 225, 226 to effect corresponding colored marking of the next work card.

A switch 231 (FIG. 12), which preferably closes briefly in response to the mounting of a new printing form 2 upon the printing drum 1, resets the binary counter 194 as well as the flip-flops 222, 223; 225, 226; 184, 185; and 154, 155.

It will be understood that each of the elements described above, or two or more together, may also find a useful application in other types of circuits and constructions differing from the types described above.

While the invention has been illustrated and described as embodied in a particular type of rotary duplicator machine, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a rotary duplicator machine of the type provided with a rotary printing drum, an image transfer location, a printing form mounted on the drum and bearing a transferrable image in the form of a text comprised of a plurality of successive lines, a counterpressure element and activatable means operative when activated for moving the counterpressure element into and out of operative position to effect transfer of the whole text, individual lines or groups of lines to sheet material transported between the printing drum and the counterpressure element, infeed rollers located upstream of the image transfer location for feeding sheet material to the image transfer location, activatable sheet feeding means operative when activated for removing whole-page sheets onto which the entire text of the printing form is to be transferred from a stack of such sheets and feeding such whole-page sheets to the infeed rollers, activatable card feeding means operative when activated for feeding to the infeed rollers cards of smaller format than the whole-page sheets and onto which only preselected portions of the text on the printing form are to be transferred, a delivery station downstream of the printing drum, an outfeed transport means for transporting printed whole-page sheets and smaller-format cards from the printing location towards the delivery station along an outfeed path having two branches, the first branch leading directly to the delivery station, the second branch including a turnover means for turning over printed cards to cause them to be deposited at the delivery station each one printed-side-down upon the back of the previously printed card, adjustable diverting means operative when activated for diverting cards transported along the outfeed path into the second branch, and activatable marking means located intermediate the printing drum and delivery station and operative when activated for providing routing markings on the printed whole-page sheets and smaller-format cards, in combination therewith, programmable control means automatically operative for activating preselectable ones of said activatable means preselectable numbers of times in preselectable sequences.

2. In a rotary duplicator machine as defined in claim 1, the programmable control means including counter means operative for counting the number of times the preselectable ones of said activatable means are activated, and operative for causing activation of predetermined ones of said activatable means to be effected in dependence upon the counted number of times predetermined other ones of said activatable means are activated.

3. In a rotary duplicator machine as defined in claim 2, the counter means comprising means operative for determining that one of the feeding means has been activated a preselected number of times and in response to such determination activating the other of the feeding means a preselected number of times.

4. In a rotary duplicator machine as defined in claim 2, the counter means comprising means operative for activating the diverting means in dependence upon activations of at least one of the feeding means.

5. In a rotary duplicator machine as defined in claim 2, the programmable control means comprising means for causing the marking means to produce different routing markings upon successive sheets and cards in predetermined sequences.

6. In a rotary duplicator machine as defined in claim 2, the programmable control means comprising means for causing the marking means to produce different routing markings upon successive sheets and cards in predetermined sequences determined by the counting state of the counter means.

7. In a rotary duplicator machine as defined in claim 2, the aforementioned moving means for the counter-pressure element being of the type comprised of a control cam arrangement including a whole-page cam and a line cam respectively operative when engaged for moving the counter-pressure element into its operative position for intervals resulting in transfer of the whole text or alternatively predetermined lines of text to sheet material transported between the printing drum and counterpressure roller and electromagnetic engaging means operative when activated for engaging one cam and disengaging the other, the counter means comprising means operative for activating the electromagnetic engaging means in response to the counting of a preselectable number of activations of the sheet feeding means.

8. In a rotary duplicator machine as defined in claim 2, the aforementioned moving means for the counter-pressure element being of the type comprised of a control cam arrangement including a line cam advanceable to a plurality of successive settings for moving the counterpressure element into operative position for intervals resulting in transfer of different respective lines of the text onto different ones of the fed cards and electromagnetic advancing means operative when activated for advancing the line cam from one setting to another, the counter means comprising means operative for activating the electromagnetic advancing means in response to the counting of a preselectable number of activations of the card feeding means.

9. In a rotary duplicator machine as defined in claim 1, the programmable control means comprising a plurality of circuit means having outputs and producing at their outputs signals indicative of which of said activatable means have been activated and how many times and having inputs for receipt of control signals indicating that preselected ones of said activatable means are to be activated, the programmable control means comprising removable program means establishing electrical connections between preselected inputs and outputs of the circuit means of the programmable control means.

10. In a rotary duplicator machine as defined in claim 1, the printing form being provided with a detectable marking in proximity to the last line or lines of text to be printed, the programmable control means including means operative for detecting the marking and ceasing further activation of the last activated one of the feeding means when the printing of the sheet or card last fed by the last activated printing means has been completed.

11. In a rotary duplicator machine as defined in claim 1, further including program-intervention means comprising preselector means settable to select the point in the preselected sequence of activations at which the operation of the programmable control means is to be interrupted, means for interrupting such operation at that point, means for effecting manually commanded activation of predetermined ones of said activatable means, and means for thereafter continuing the operation of the programmable control means.

12. In a rotary duplicator machine as defined in claim 1, the sheet feeding means including a sheet storage and the card feeding means including a card storage, the feeding means being provided with means for determining the numbers of sheets and cards in the storages, the programmable control means including means operative when the number of sheets and cards in the storages is insufficient for the preselected numbers of activations of the preselected ones of said activatable means for preventing the preselected activations.

* * * * *